US009048562B2

(12) United States Patent
Muller et al.

(10) Patent No.: US 9,048,562 B2
(45) Date of Patent: Jun. 2, 2015

(54) CONTACTING SYSTEM FOR PRODUCING ELECTRICAL CONTACT BETWEEN A CABLE AND A SENSOR

(71) Applicant: Endress + Hauser Conducta Gesellschaft für Mess— und Regeltechnik mbH + Co. KG, Gerlingen (DE)

(72) Inventors: Andreas Muller, Ostfildern (DE); Carsten Gotz, Ettenheim (DE); Matthias Grossmann, Vaihingen-Enz (DE)

(73) Assignee: Endress + Hauser Conducta Gesellschaft für Mess- und Regeltechnik mbH + Co. KG, Gerlingen (DE)

( * ) Notice: Subject to any disclaimer, the term of this patent is extended or adjusted under 35 U.S.C. 154(b) by 140 days.

(21) Appl. No.: 13/942,777

(22) Filed: Jul. 16, 2013

(65) Prior Publication Data

US 2014/0024238 A1 Jan. 23, 2014

(30) Foreign Application Priority Data

Jul. 17, 2012 (DE) ..... 10 2012 106 421

(51) Int. Cl.
*H01R 13/52* (2006.01)
*H01R 43/04* (2006.01)
*H01R 13/6581* (2011.01)
*H01R 13/512* (2006.01)

(52) U.S. Cl.
CPC ..... *H01R 13/5205* (2013.01); *Y10T 29/49174* (2015.01); *H01R 43/04* (2013.01); *H01R 13/512* (2013.01); *H01R 13/6581* (2013.01)

(58) Field of Classification Search
CPC ..... H01R 13/5205; H01R 43/04; H01R 13/6581; H01R 13/512
USPC ..... 439/271–277, 470–472
See application file for complete search history.

(56) References Cited

U.S. PATENT DOCUMENTS

| | | | | |
|---|---|---|---|---|
| 7,717,725 | B2 * | 5/2010 | Montena | 439/277 |
| 8,087,949 | B2 * | 1/2012 | Palinkas et al. | 439/277 |
| 8,167,635 | B1 * | 5/2012 | Mathews | 439/277 |
| 8,172,595 | B2 * | 5/2012 | Bartholoma et al. | 439/277 |
| 8,398,421 | B2 * | 3/2013 | Haberek et al. | 439/277 |

* cited by examiner

*Primary Examiner* — Khiem Nguyen
(74) *Attorney, Agent, or Firm* — Bacon & Thomas, PLLC

(57) ABSTRACT

A contacting system, comprising: an essentially cylindrical contact body having at least a first opening, a second opening and a contact body interior between the first opening and the second opening. The first opening is embodied for accommodating the cable, wherein a holding element is provided in the contact body interior and is so embodied that it produces contact between the first conductor and the contact body. A sealing element is provided at the first opening and is so embodied that it seals off the contact body interior from the medium.

13 Claims, 4 Drawing Sheets

CONTACTING SYSTEM FOR PRODUCING ELECTRICAL CONTACT BETWEEN A CABLE AND A SENSOR

TECHNICAL FIELD

The invention relates to a contacting system for producing electrical contact between a cable and a sensor.

BACKGROUND DISCUSSION

Certain sensors, for example, optical turbidity—or nitrate probes for the water—and waste water field, are located over long periods of time in the medium to be measured. In such case, the measured signals and the required energy are transmitted via a connected cable. The exit of the cable from the sensor must, in such case, be sealed such that no medium can get into the sensor. This is accomplished, as a rule, by cable screw connections, whose sealing element is compressed radially around the cable jacket, such that there is plastic deformation upon the closing of the screw connection.

In order to fulfill requirements for electromagnetic compatibility (EMC) of the sensor, cable screw connections are used with special EMC connections. Involved, in such case, as a rule, are spring- or claw-shaped, metal elements, which, upon the screwing together, engage in the braided shield of the cable and hook there. Predominantly, the line to ground, and therewith, the EMC-drain, is routed via the outer conductor (also called the cable shield).

An opening of the cable screw connection for servicing is, as a rule, only possible with the application of considerable force and leads, most often, to destruction of the sealing element and to plastic deformation of the EMC connection.

The screw connection must, consequently, be completely replaced, in order to obtain a reliable sealing and a functional EMC connection. This is associated with considerable work and cost.

SUMMARY OF THE INVENTION

An object of the invention, therefore, is to provide a cable connection, which assures a safe EMC drain and which can be opened and closed multiple times.

The object is achieved by a contacting system for producing electrical contact between a cable and a sensor, wherein the cable includes at least a first conductor and a second conductor, and wherein the sensor is embodied for determining a chemical and/or physical, measured variable in a medium, comprising: an essentially cylindrical contact body having at least a first opening at a first end region, a second opening at a second end region and a contact body interior between the first opening and the second opening, wherein the first opening is embodied for accommodating the cable, wherein a holding element is provided in the contact body interior and the holding element is so embodied that it produces contact between the first conductor and the contact body, wherein a sealing element is provided at the first opening and is so embodied that it seals off the contact body interior from the medium, and wherein a first connection structure and a first contact structure are provided; and an essentially cylindrical cable end piece, wherein a second connection structure corresponding to the first connection structure is provided for mechanical connection of the contact body to the cable end piece, wherein a second contact structure corresponding to the first contact structure is provided for electrical contacting of the contact body to the cable end piece, wherein at least a first opening at a first end region of the cable end piece, a second opening at a second end region of the cable end piece and a cable end piece interior between the first opening and the second opening are provided, wherein the first opening of the cable end piece is embodied for accommodating the second end region of the contact body, and wherein at least a first sealing element is provided in the region of the first opening and the first sealing element is so embodied that it seals off the cable end piece interior from the medium.

Via the fixedly connected unit, cable/contact body, and the connected cable end piece, it is possible to open and close the contacting system multiple times, without degrading the sealing action and the EMC connection. The unit cable/contact body can in the case of released connection structure be shifted within the cable end piece as much as desired in the cable direction. In this way, a twisting or severing of the plug in the case of assembly or disassembly is avoided, since cable/contact body remains in the rest position relative to the sensor.

In a preferred embodiment, a third connection structure is provided on the cable end piece, wherein there is provided on the sensor a fourth connection structure complementary to the third connection structure for mechanical connection of the sensor to the cable end piece, wherein at least a second sealing element is provided on the second opening of the cable end piece and is so embodied that it seals off the cable end piece interior from the medium, and wherein at least the second conductor contacts the sensor.

Thus, it is possible simultaneously to contact the sensor with the cable end piece mechanically and electrically, to maintain the sealing action and to achieve an EMC connection.

Preferably, the first conductor is a cable shield. Frequently, the cable shield is used as the line to ground, and the EMC drain can occur through such line to ground.

In an advantageous further development, the sealing element is embodied as an elastic packing material and a compression nut. Thus, no medium can penetrate into the contact body.

In a preferred form of embodiment, the holding element is embodied as an electrically conducting structure with a pressing area and presses the first conductor against the wall of the contact body interior. In this way, any EMC event is drained away.

Alternatively, the holding element is embodied as an electrically conducting spring element and the first conductor is contacted with the wall of the contact body interior by clawing.

Preferably, the at least one connection structure is a coupling nut with corresponding thread, in order to connect the contact body optimally with the cable end piece. Alternatively, set screws can be used.

Also, a connection structure can be an external thread with corresponding internal thread.

In a preferred further development, at least one of the sealing elements can be a radial seal, especially an O-ring-seal, with a coupling nut. This first sealing option assures an optimal sealing action, and no medium can penetrate into the interior of the cable end piece.

Alternatively, an axial seal, especially an O-ring-seal, with a coupling nut is provided.

Preferably, the contacting structures are embodied as inclined abutment surfaces. In this way, an EMC event can be ideally drained away.

The object is furthermore achieved by a method comprising the following steps:

leading the cable through the first opening of the contact body, producing contact between the first conductor and the contact body, sealing the contact body interior, producing contact between the second conductor and the sensor, connecting the cable end piece with the sensor, and connecting the contact body with the cable end piece.

The steps must only be done once. If a sensor changed, the following steps are sufficient:

opening the cable end piece and decontacting the second conductor, producing contact between the second conductor and the sensor, connecting the cable end piece with the sensor, and connecting the contact body with the cable end piece.

BRIEF DESCRIPTION OF THE DRAWINGS

The invention will now be explained in greater detail based on the appended drawing, the figures of which show as follows.

DETAILED DESCRIPTION IN CONJUNCTION WITH THE DRAWINGS

Figure 1:
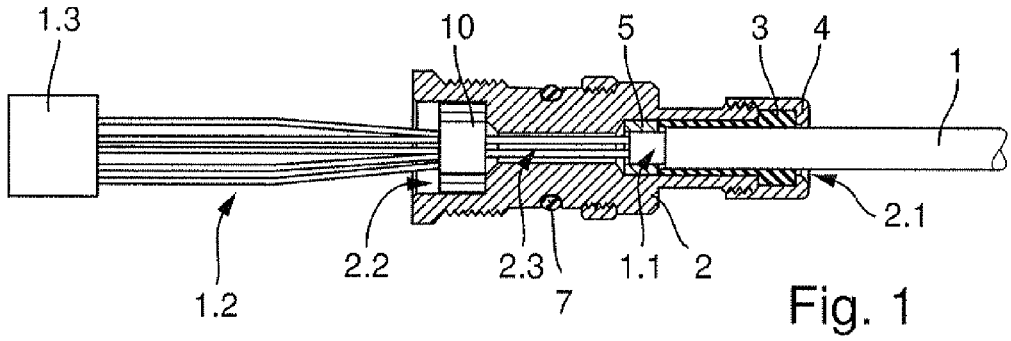
FIG. 1 is a cross section through the contact body with cable.

In the figures, equal features are provided with equal reference characters.

The contacting system of the invention in its totality bears the reference character 100 (FIG. 5) and comprises the contact body 2 and the cable end piece 6. Contacting system 100 is located with the sensor 11 in the medium to be measured.

With reference to FIG. 1, the contact body 2 will first be discussed. Contact body 2 is essentially cylindrical and manufactured, for example, of stainless steel, at least, however, of an electrically conducting material. The material must be resistant to the medium. Contact body 2 has a first opening 2.1 at a first end region and a second opening 2.2 at a second end region, while therebetween lies the contact body interior 2.3.

Led through the opening 2.1 at the first end region is the cable 1. Cable 1 contains at least a first conductor 1.1 and a second conductor 1.2. The first conductor 1.1 is embodied as outer conductor, also called the cable shield. Most often this is utilized as the line to ground.

The first conductor is pressed by means of a holding element 5 against the contact body 2, whereby an electrically conducting connection arises. This can be accomplished, for example, by turning the first conductor 1.1 inside out, such that it is pulled counter to the introduction direction of the cable 1 into the contact body 2, with subsequent radial compression of the conductor 1.1, for instance, by an O-ring, against the contact body interior 1.3. Other embodiments for accomplishing this include spring elements clawing into the conductor 1.1.

Inserted at the first opening 2.1 at the first end region of the contact body 2 is an elastic sealing element 3. Sealing element 3 is secured using a compression nut 4 and prevents that medium can penetrate through the first opening 2.1 into the contact body interior 1.3.

The second and other conductors 1.2 are led through the contact body 2 and out from the opening 2.2 at the second end region. Provided on the contact body 2 is a clamp 10 serving as strain relief for the cable 1.

Figure 2:
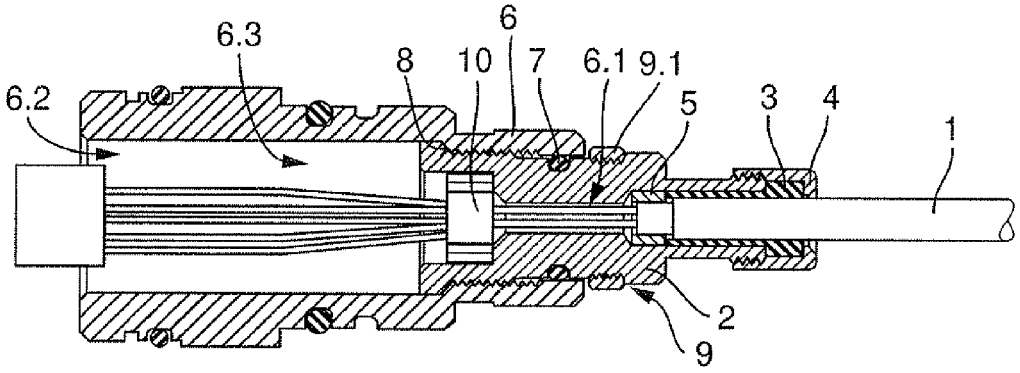
FIG. 2 is a cross section through the contact body with the cable end piece.

FIG. 2 contains additionally the cable end piece 6. The cable end piece 6 is essentially cylindrical and produced of stainless steel, at least, however, an electrically conductive material. The material must be resistant to the medium. The cable end piece 6 has a first opening 6.1 at a first end region and a second opening 6.2 at a second end region, while therebetween lies the cable end piece interior 6.3.

The opening 6.1 at the first end region is so embodied that it can be led over the opening 2.2 on the second end region of the contact body 2. Located on the second end region of the contact body 2 is an abutment surface 8. Located on the cable end piece 6 is an area corresponding thereto. Via this abutment surface 8, the contact body 2 is in electrical contact with the cable end piece 6.

With the help of a connection structure 9, contact body 2 and cable end piece 6 are mechanically connected. In FIG. 2, this is shown in the form of a coupling nut 9.1. In such case, a screw thread (not shown) is located on the contact body 2. Upon tightening the nut, contact body 2 and cable end piece 6 are drawn into contact on the abutment surface 8.

Figure 3:
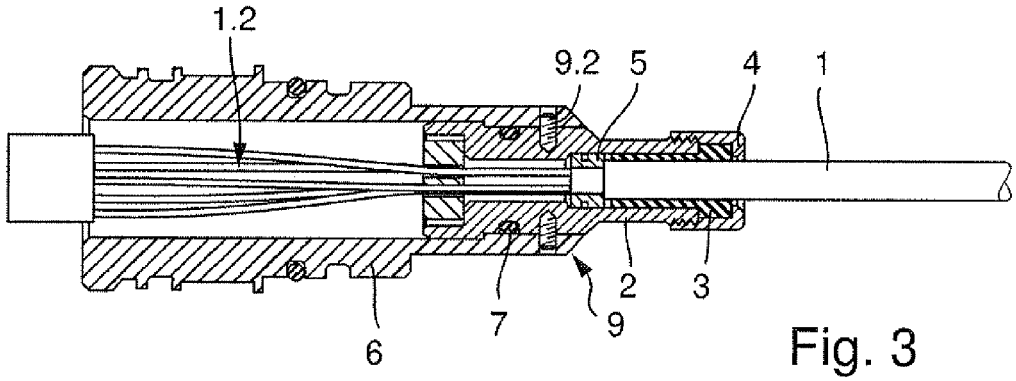
FIG. 3 is a cross section through the contact body with the cable end piece in one embodiment.

FIG. 3 shows the connection structure 9 in the form of set screws 9.2.

Located at the opening 6.1 at the first end region of the cable end piece 6 is a sealing element 7, for example, an O-ring. The sealing element 7 is embodied as a radial seal. This assures that no medium can penetrate through the first end region of the cable end piece 6 into the cable end piece interior 6.3.

Figure 4:
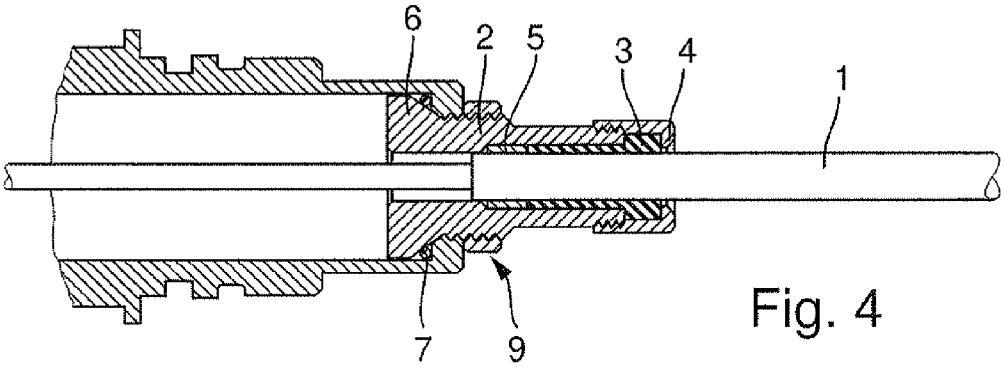
FIG. 4 is a cross section through the contact body with the cable end piece in an additional embodiment.

FIG. 4 shows an embodiment of the sealing element 7 as an axial seal.

Figure 5:
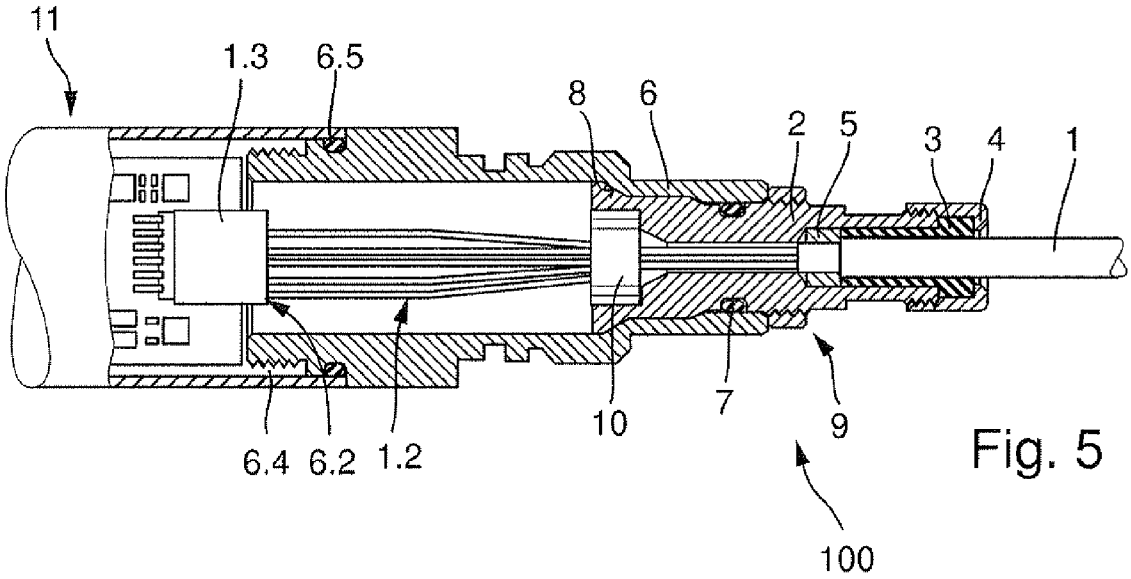
FIG. 5 is a cross section through the contacting system of the invention with a sensor.
Figure 6A:
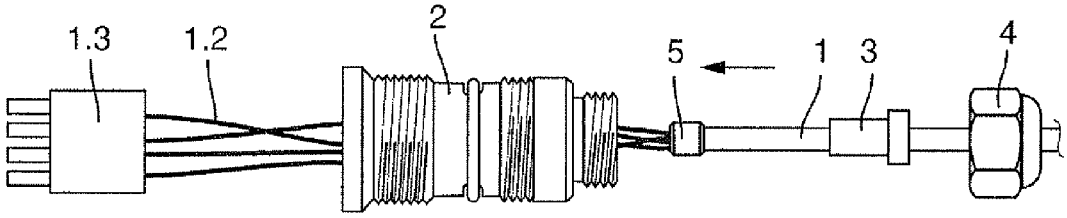
FIGS. 6A-6G show the sequence of assembly of the contacting system.
Figure 6B:
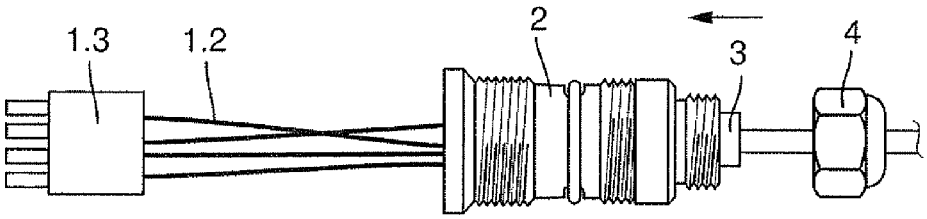
Figure 6C:
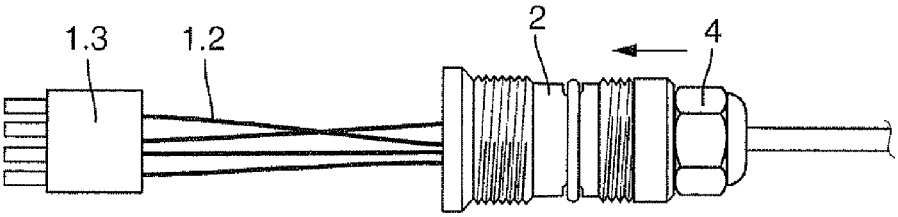
Figure 6D:
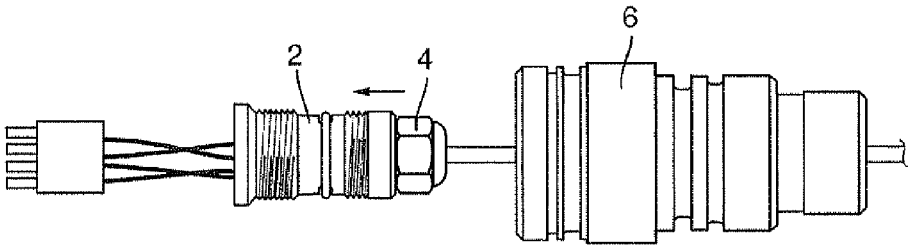
Figure 6E:
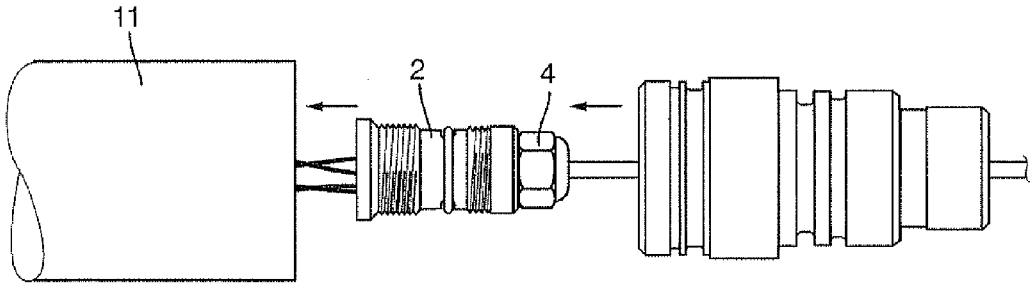
Figure 6F:
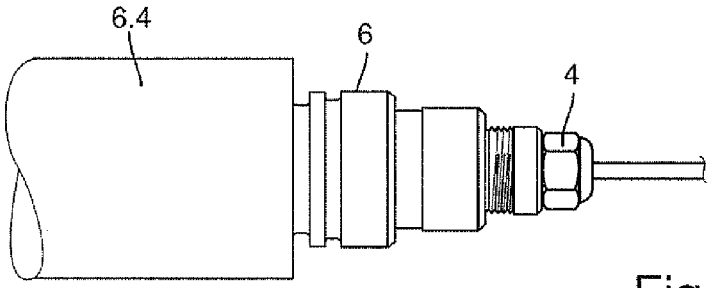
Figure 6G:
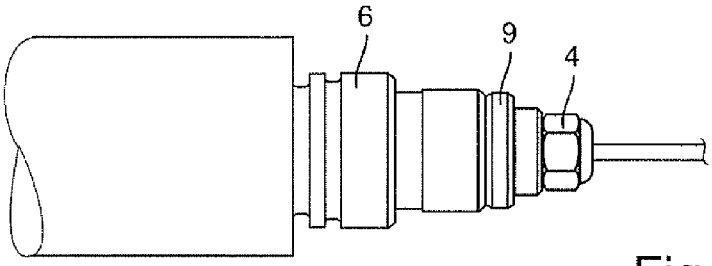

FIG. 5 shows the contacting system 100 with contact body 2 and cable end piece 6. In the second end region of the cable end piece 6 is located a screw thread 6.4. This screw thread 6.4 connects the contacting system 100 mechanically with the sensor 11. Located on the sensor 11 is a corresponding structure for the screw thread 6.4. The sensor 11 is electrically connected with the cable 1, especially with the conductors 1.2, via a plug 1.3.

FIG. 6 shows the sequence of assembly of the contacting system with the sensor 11. FIG. 6*a* shows from left to right: The plug 1.3 for electrically contacting the sensor 11, the conductors 1.2, the contact body 2, the holding element 5 for clamping the first conductor 1.2, the cable 1, the sealing element 4 and the compression nut 4. In FIG. 6*b*, the holding element 5 is pushed into the contact body 2 and, in FIG. 6*c*, the assembly is sealed with the sealing element 3 and the compression nut 4. In FIG. 6*d*, the cable end piece 6 is pushed over the contact body 2. In FIG. 6*e*, electrical contact is produced with the sensor 11. In FIG. 6*f*, the screwed connection between the cable end piece 6 and the sensor 11 is produced. And, in FIG. 6*g*, is the cable end piece 6 and the contact body 2 are locked together with the connecting element 9.

The described construction permits the contacting system 100 to be opened and closed multiple times, without degrading the sealing action and the EMC connection. Because cable 1 and contact body 2 form a unit, cable 1 is not twisted when opening and closing the screw connection. This unit can in the case of released connection structure 9 be shifted within the cable end piece 9 as much as desired in the cable direction. In this way, a twisting or severing of the plug 1.3 in the case of assembly or disassembly is avoided, since cable/contact body remains in the rest position relative to the sensor 11.

The invention claimed is:

1. A contacting system for producing electrical contact between a cable and a sensor, wherein the cable includes at least a first conductor and a second conductor, and wherein the sensor is embodied for determining a chemical and/or physical, measured variable in a medium, comprising:

an essentially cylindrical contact body having at least a first opening at a first end region, a second opening at a second end region and a contact body interior between said first opening and said second opening, said said first opening is embodied for accommodating the cable;

a holding element provided in said contact body interior, said holding element is so embodied that it produces contact between said first conductor and said contact body;

a sealing element provided at said first opening which is so embodied that it seals off said contact body interior from the medium; and a first connection structure and a first contact structure are provided;

an essentially cylindrical cable end piece;

a second connection structure corresponding to said first connection structure provided for mechanical connection of said contact body to the said cable end piece;

a second contact structure corresponding to said first contact structure provided for electrical contacting of said contact body to said cable end piece, wherein:

at least a first opening at a first end region of said cable end piece, a second opening at a second end region of said cable end piece and a cable end piece interior between said first opening and said second opening are provided;

said first opening of said cable end piece is embodied for accommodating said second end region of said contact body; and at least a first sealing element is provided in the region said first opening and is so embodied that it seals off said cable end piece interior from the medium.

2. The contacting system as claimed in claim 1, wherein:

a third connection structure is provided on said cable end piece;

a fourth connection structure provided on said sensor complementary to said third connection structure for mechanical connection of the sensor to said cable end piece;

at least a second sealing element is provided on said second opening of said cable end piece and is so embodied that it seals off said cable end piece interior from the medium; and at least said second conductor contacts the sensor.

3. The contacting system as claimed in claim 1, wherein:

said first conductor is a cable shield.

4. The contacting system as claimed in claim 1, wherein:

said sealing element is embodied as an elastic packing material and a compression nut.

5. The contacting system as claimed in claim 1, wherein:

said holding element is embodied as an electrically conducting structure with a pressing area and presses the first conductor against the wall of said contact body interior.

6. The contacting system as claimed in claim 1, wherein:

said holding element is embodied as an electrically conducting spring element, and said first conductor is contacted with the wall of said contact body interior by clawing.

7. The contacting system as claimed in claim 1, wherein:

said at least one connection structure is a coupling nut with corresponding thread.

8. The contacting system as claimed in claim 1, wherein:

said at least one connection structure comprises set screws with corresponding cavities.

9. The contacting system as claimed in claim 1, wherein:

said at least one connection structure comprises an external thread with corresponding internal thread.

10. The contacting system as claimed in claim 1, wherein:

at least one of the sealing elements is a radial seal, especially an O-ring-seal, with a coupling nut.

11. The contacting system as claimed in claim 1, wherein:

said at least one sealing element is an axial seal, especially an O-ring-seal, with a coupling nut.

12. The contacting system as claimed in claim 1, wherein:

the contacting structures are embodied as inclined abutment surfaces.

13. A method for producing electrical contact between a cable and a sensor with a contacting system for producing electrical contact between a cable and a sensor, wherein the cable includes at least a first conductor and a second conductor, and wherein the sensor is embodied for determining a chemical and/or physical, measured variable in a medium, comprising: an essentially cylindrical contact body having at least a first opening at a first end region, a second opening at a second end region and a contact body interior between said first opening and said second opening, said first opening is embodied for accommodating the cable; a holding element provided in said contact body interior, said holding element is so embodied that it produces contact between said first conductor and said contact body; a sealing element provided at said first opening which is so embodied that it seals off said contact body interior from the medium; and a first connection structure and a first contact structure are provided; an essentially cylindrical cable end piece; a second connection structure corresponding to said first connection structure provided for mechanical connection of said contact body to the said cable end piece; a second contact structure corresponding to said first contact structure provided for electrical contacting of said contact body to said cable end piece, wherein: at least a first opening at a first end region of said cable end piece, a second opening at a second end region of said cable end piece and a cable end piece interior between said first opening and said second opening are provided; said first opening of said cable end piece is embodied for accommodating said second end region of said contact body; and at least a first sealing element is provided in the region said first opening and is so embodied that it seals off said cable end piece interior from the medium, the method comprising the steps of:

leading the cable through the first opening of the contact body;

producing contact between the first conductor and the contact body;

sealing the contact body interior;

producing contact between the second conductor and the sensor;

connecting the cable end piece with the sensor; and connecting the contact body with the cable end piece.

* * * * *